United States Patent [19]

Sexton et al.

[11] Patent Number: 4,549,372

[45] Date of Patent: Oct. 29, 1985

[54] GRINDING WHEEL

[75] Inventors: John S. Sexton, Windsor; Brian J. Stone, Bristol; Trevor D. Howes, Bristol; Colin Andrew, Bristol, all of England

[73] Assignee: De Beers Industrial Diamond Division (Proprietary) Limited, Johannesburg, South Africa

[21] Appl. No.: 559,007

[22] Filed: Dec. 8, 1983

Related U.S. Application Data

[63] Continuation of Ser. No. 248,905, Mar. 30, 1981, abandoned.

[30] Foreign Application Priority Data

Apr. 2, 1980 [GB] United Kingdom ..... 8010991

[51] Int. Cl.[4] ..... B24D 13/12

[52] U.S. Cl. ..... 51/206 R; 51/168; 51/394

[58] Field of Search ..... 51/206 R, 206.4, 206 NF, 51/209, 207, 168, 328, 281 R, 394, 404, 407, 354, 401

[56] References Cited

U.S. PATENT DOCUMENTS

| | | | |
|---|---|---|---|
| 158,617 | 1/1875 | Bannister et al. | 51/168 |
| 2,024,591 | 12/1935 | Manchester | 51/206 R |
| 2,221,173 | 11/1940 | Gutsell . | |
| 2,304,226 | 12/1942 | Work et al. | 51/168 |
| 2,436,466 | 2/1948 | Wilson | 51/168 |
| 2,709,879 | 6/1955 | Larson . | |
| 2,763,969 | 9/1956 | Larson . | |
| 2,860,458 | 11/1958 | Raske . | |
| 2,870,582 | 10/1959 | Raske . | |
| 3,036,412 | 5/1962 | Guilbert | 51/168 |
| 3,188,775 | 9/1965 | Cosmos . | |
| 3,641,718 | 2/1972 | Ferchland | 51/207 |
| 3,772,831 | 11/1973 | Shaw | 51/206 R |
| 3,828,489 | 8/1974 | Culley . | |
| 3,886,925 | 6/1975 | Regan | 51/206 R |
| 4,047,902 | 9/1977 | Wiand | 51/209 R |
| 4,099,934 | 7/1978 | Suzuki et al. | 51/295 |
| 4,354,328 | 10/1982 | Ainoura | 51/206.4 |

FOREIGN PATENT DOCUMENTS

| | | | |
|---|---|---|---|
| 504055 | 11/1928 | Fed. Rep. of Germany . | |
| 541125 | 3/1929 | Fed. Rep. of Germany . | |
| 640452 | 7/1934 | Fed. Rep. of Germany . | |
| 1040411 | 10/1958 | Fed. Rep. of Germany . | |
| 2405048 | 2/1974 | Fed. Rep. of Germany . | |
| 437352 | 1/1934 | United Kingdom | 51/281 |
| 1199404 | 7/1970 | United Kingdom . | |
| 1505943 | 8/1975 | United Kingdom . | |
| 0370020 | 4/1973 | U.S.S.R. | 51/206 R |
| 0763047 | 9/1980 | U.S.S.R. | 51/206 R X |

OTHER PUBLICATIONS

Abrasive Methods Engineering, F. T. Farago, ©1976, p. 72.

*Primary Examiner*—Frederick R. Schmidt
*Assistant Examiner*—Robert A. Rose
*Attorney, Agent, or Firm*—Cushman, Darby & Cushman

[57] ABSTRACT

A semi-permanent peripheral grinding wheel comprising ultrahard abrasives such as diamond or cubic boron nitride is provided which overcomes the serious problems caused by "chatter". The wheel comprises a hub mounting the ultrahard abrasive, the abrasive being resiliently depressible radially inwardly of the wheel. The wheel preferably has a radial static stiffness of no more than $1.5 \times 10^6$ N/m per mm. of wheel width and a first radial natural frequency of at least 500 Hertz. The resiliency may be provided by rubber pads between the abrasive and the hub, or by mounting the abrasive on a hub made of resiliently deformable metal such as "RETIMET" (Registered Trade Mark) sponge-like metal.

10 Claims, 8 Drawing Figures

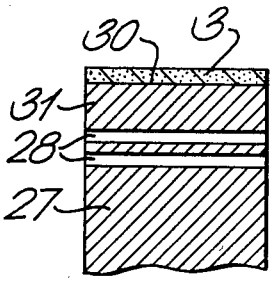
FIG. 6.
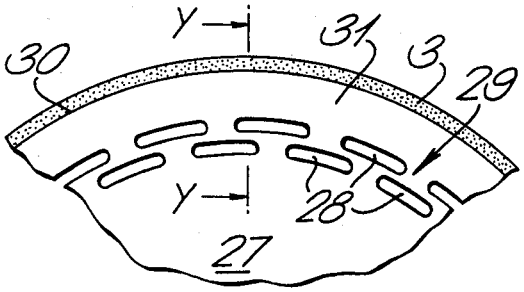
FIG. 5.
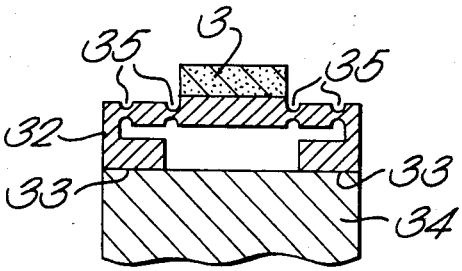
FIG. 7.
FIG. 8.
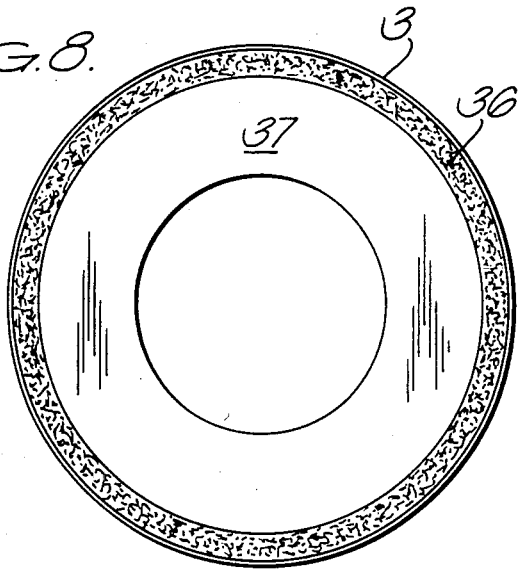

GRINDING WHEEL

This is a continuation of application Ser. No. 248,905, filed Mar. 30, 1981, now abandoned.

This invention relates to a semi-permanent peripheral grinding wheel.

Semi-permanent grinding wheels comprise ultrahard abrasives, for example diamond or cubic boron nitride grit, and derive their name from the fact that when compared with conventional grinding wheels, they have a very much lower rate of wear. Typical volumetric wear rates for conventional aluminium oxide or silicon carbide grinding wheels might be 10 to 100 times higher than those of semi-permanent grinding wheels. This property of low wear, however, makes semi-permanent grinding wheels susceptible to an unstable self-excited vibration known as chatter, a phenomenon which is experienced commonly when using them in normal shallow cut grinding operations. During the course of grinding, there is a build-up of a waviness around the periphery of the grinding wheel. The effect is that not only is the performance of the grinding wheel detrimentally affected, but "chatter marks" are left on the workpiece surface, and this often renders the workpiece unacceptable.

Chatter is to be differentiated from other forms of machine tool vibration, such as force vibration, which may be caused for example, by an out-of-balance wheel. So-called anti-vibration grinding wheels are available to meet these other forms of vibration, but are not designed to meet the problem of chatter. U.S. Pat. Nos. 2,304,226 and 3,036,412, for example, propose grinding wheels provided with a resilient bushing or coupling to reduce shock and vibration, which therefore improve the grinding ratios of the wheels.

Previous attempts to suppress chatter have involved expensive and complex modifications of the grinding machine, including one or more of the following, namely, increasing the damping of the machine, the use of vibration absorbers, and cyclically varying the wheel and/or workpiece speed, as by the provision of a variable speed drive.

In accordance with the present invention, the approach to the suppression of chatter involves the modification of the grinding wheel by the introduction of a degree of radial flexibility into the wheel.

The present invention provides a semi-permanent peripheral grinding wheel comprising a hub mounting an ultrahard abrasive, said abrasive being resiliently depressible radially inwardly of the wheel.

By the use of a semi-permanent peripheral grinding wheel in accordance with the present invention, the propensity of the wheel to chatter, and the adverse effects of chattering, are reduced or eliminated. Thereby, the intervals between the lengthy truing operations on the grinding wheel are extended, and therefore the life of the wheel is prolonged and the grinding operation is rendered more economic. Moreover, the surface finish of the workpiece is technically more acceptable.

The resiliency or flexibility of grinding wheels in accordance with the present invention is best indicated by their radial static stiffness. In general, grinding wheels in accordance with the present invention have a radial static stiffness of no more than $1.5\times10^6$ Newtons/meter per mm. of wheel width. This is to be contrasted with the relatively high radial static stiffness of conventional semi-permanent grinding wheels, including so-called anti-vibration wheels. A method of measuring radial static stiffness is described hereinafter. Preferably the grinding wheels of the present invention have a radial static stiffness of no more than $1.0\times10^6$ N/m per mm. of wheel width, most preferably no more than $0.5\times10^6$ N/m per mm. of wheel width.

The grinding wheels of the present invention should have as high as possible values for first radial natural frequency and damping, that is to say, when a wheel is excited at a point on the periphery with the hub held stationary, the periphery will oscillate with as high and as well damped a first radial natural frequency as possible. To obtain a high first radial natural frequency for a given resiliency, a low oscillating mass is required, as the first radial natural frequency is inversely proportional to the mass of the wheel. First radial natural frequencies of two or more times the predominant natural frequency of the grinding machine in which the wheel is to be incorporated are preferred.

The grinding wheels of the present invention preferably have a first radial natural frequency of at least 500 Hertz, even more preferably at least 1000 Hertz. The first radial natural frequency of a wheel can be measured by well-known techniques.

The ultrahard abrasive particles may, for example, be the thickness of a single layer of the abrasive particles, as in an electroplated tool. Preferably however, the abrasive particles are included in a peripheral grinding rim, and accordingly the present invention further provides a semi-permanent peripheral grinding wheel comprising a hub mounting an ultrahard abrasive-containing rim, said rim being resiliently depressible radially inwardly of the wheel.

According to an aspect of the present invention, there is provided a semi-permanent peripheral grinding wheel comprising a hub mounting an ultrahard abrasive-containing rim, said rim being supported for depression relative to said hub against the thrust of resilient means.

According to this aspect of the present invention, the rim may be secured to an annular support, e.g. a hoop or ring preferably made of metal e.g. aluminium, which is supported by said resilient means.

In accordance with one embodiment of the grinding wheel of the present invention, the whole rim is resiliently displaced from concentricity on depression thereof at a point on its periphery with no, or minimal, loss in the circular shape thereof.

For example, in accordance with this embodiment, the rim is secured to a comparatively rigid annular support which is in turn resiliently supported by resilient shear and/or compression pads which permit depression of the rim and which return the rim to concentricity when the depression force is removed.

In accordance with another embodiment of the grinding wheel of the present invention, only localised deformation of the rim occurs on depression thereof at a point on its periphery so that although there is a slight loss of circular shape, there is no significant loss of concentricity.

For example, in accordance with this embodiment, the rim is secured to a flexible annular support which, if not resilient, is itself supported on a continuous resilient ring, or a series of resilient pads, which permit depression of said rim and which return the rim to its circular shape when the depression force is removed.

The hub may be of metallic, or non-metallic material, such as steel, aluminium, resin/aluminium, or thermosetting organic resin with additional metallic and/or non-metallic fillers. It may be formed of one or more pieces.

In accordance with another aspect of the present invention, the hub is made wholly or partly of a resiliently deformable material, and the rim is secured directly thereto. When the hub is partly made of the resiliently deformable material, the material constitutes an outer annulus of the hub. A number of resiliently deformable materials may be used for the hub, including metals and plastics and other materials apparent to those skilled in the art, provided they have the necessary strength for the purpose.

One preferred material is a sponge-like metal as, for example, that sold by Dunlop Aviation under the Registered Trade Mark "RETIMET" and described in British Pat. No. 1,199,404. Hubs constituted partly or wholly by this material have the necessary resiliency to achieve the benefits of the present invention.

It will be understood that grinding wheels in accordance with the present invention must be elastically or resiliently depressible throughout the range of forces to which they will be subjected in use.

The rim is composed of ultrahard abrasive particles, e.g. diamond (natural and/or synthetic) and/or cubic boron nitride (CBN) abrasive particles, bonded in a matrix, e.g. a synthetic resin, vitreous, or metallic matrix. The matrix may contain fillers or other additives known in the art. The rim may be, for example, below 1 mm to above 6 mm in thickness.

When the matrix is a synthetic resin, e.g. a phenolic resin, a polyimide resin, or other thermosetting organic resin, the diamond and/or cubic boron nitride abrasive particles may be metal-coated, e.g. nickel- or copper-coated, to aid retention of the abrasive particles in the matrix.

A semi-permanent grinding wheel in accordance with the present invention may be incorporated in a grinding machine in known manner. CBN abrasives are of particular use in grinding steel, for example, high-speed steel (HSS). Diamond abrasives are of particular use in grinding non-ferrous materials in general, particularly glass and carbides.

Some preferred embodiments of the semi-permanent peripheral grinding wheel in accordance with the present invention will now be described, by way of example, with reference to the accompanying diagrammatic drawings, in which:

FIG. 5 is a side elevation of part of an even further alternative grinding wheel;

FIG. 6 is a section on line Y—Y of FIG. 5;

FIG. 7 is a similar section through a yet even further alternative grinding wheel; and FIG. 8 is a side elevation of another alternative grinding wheel.

In the drawings, like reference numerals indicate the same or similar parts.

Figure 1:
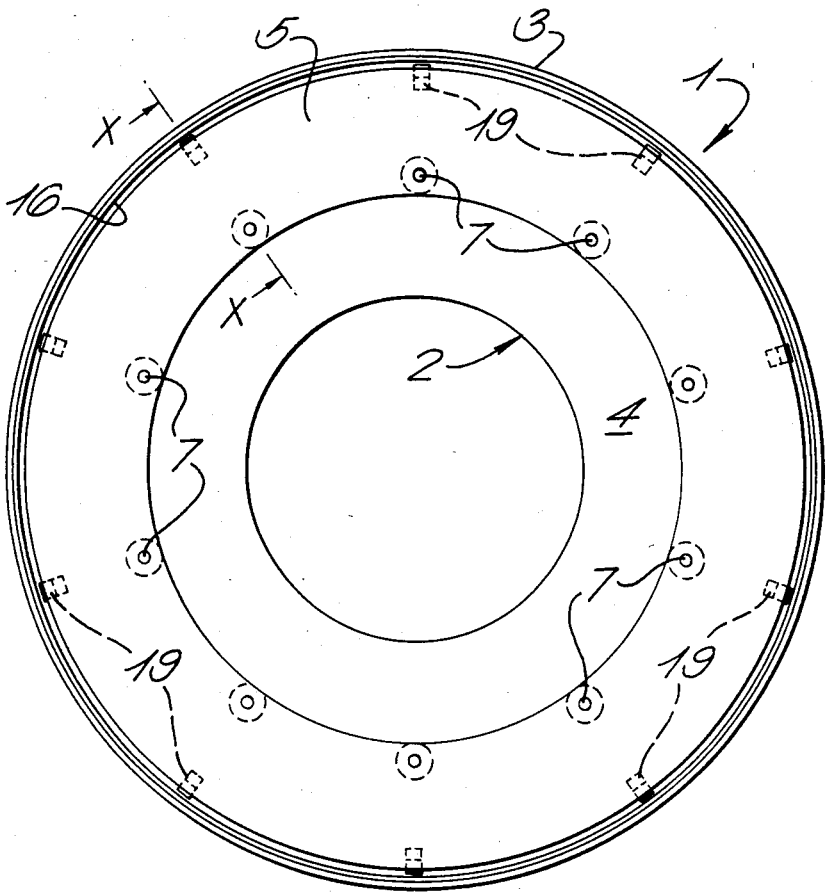
FIG. 1 is a side elevation of one grinding wheel.
Figure 2:
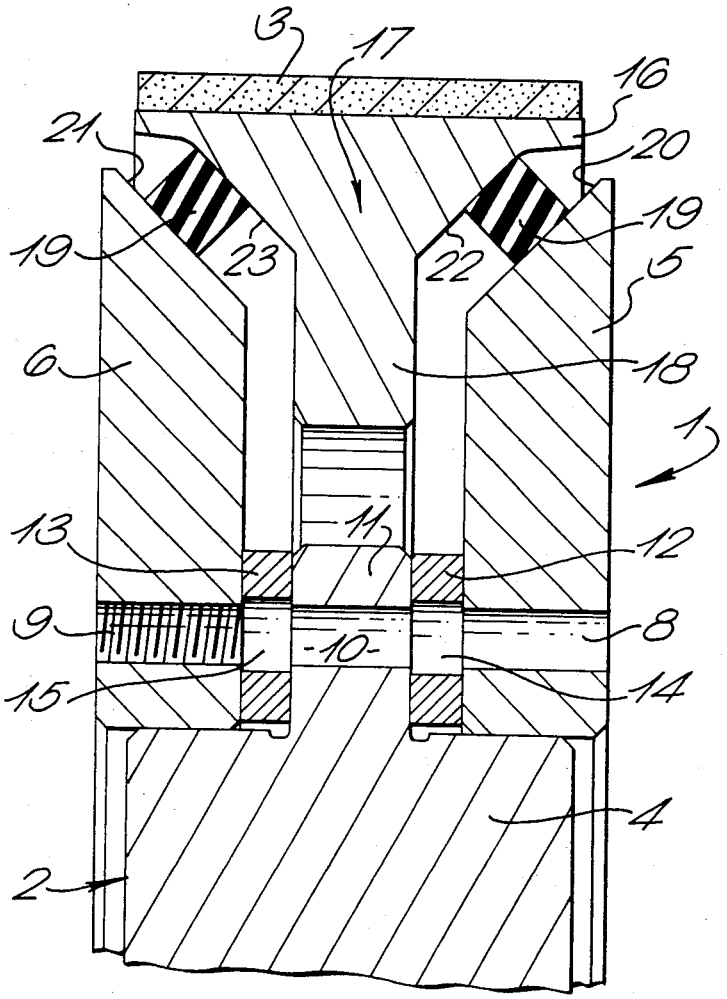
FIG. 2 is an enlarged section on line X—X of FIG. 1.

Referring to FIGS. 1 and 2 of the accompanying drawings, the semi-permanent grinding wheel 1 is of the straight peripheral type (1A1) and comprises a hub 2 mounting on abrasive-containing rim 3, said rim 3 being resiliently depressible radially inwardly of said wheel as hereinafter described.

The hub 2 is constructed from three aluminium pieces, namely a central core 4 adapted for mounting on the spindle of a grinding machine (not shown), and two annular ring members 5,6 seated on said core 4 as shown. Members 5,6 are secured to the core 4 by bolts 7 which pass through holes 8,9 in ring members 5,6 respectively, and hole 10 in a stub-flange 11 integral with said core 4. Ring members 5,6 are spaced from said stub-flange 11 by spacers 12,13 drilled at 14,15 respectively.

The abrasive-containing rim 3 may be produced in known manner from ultrahard abrasive particles such as diamond (natural and/or synthetic) and/or cubic boron nitride abrasive particles and a matrix, e.g. a synthetic resin, vitreous, or metal matrix. A preferred synthetic resin matrix is a phenol-formaldehyde resin matrix, but other thermosetting organic resin matrices may be employed, e.g. polyimides or modified phenolics. The diamond and/or cubic boron nitride abrasive particles may be uncoated or metal-coated, as e.g. by nickel or copper.

The rim 3 is supported on the cross-piece 16 of a T-section aluminium ring support 17 as shown, the upright 18 of the T extending radially inwards towards, and spaced from, the stub-flanged 11. If desired, the upright of the T-section ring 17 may be reduced in height to reduce weight.

Fitted between the hub 2 and rim 3 are pairs of resilient compression pads 19, e.g. formed of rubber such as "Neoprene" rubber and providing an intermediate annular structure. The pads 19 are each seated, on opposite sides thereof, on, i.e. are contiguous a chamfered surface 20,21 of ring members 5,6, and on a co-operating inclined undersurface 22,23 of the ring support 17 as shown.

The grinding wheel 1 is so assembled that the rim 3 is resiliently supported and can be resiliently depressed radially inwardly of said wheel, as by the workpiece during a grinding operation, against the thrust of the compression pads 19, at any point on the periphery of the rim 3.

In this embodiment, depression of the rim 3 effects displacement of the rim 3 from concentricity of eccentricity relative to the hub 2 without loss of circular shape of the rim 3. When the force causing the displacement is removed, the rim is returned to concentricity under the thrust of the compression pads 19.

Figure 3:
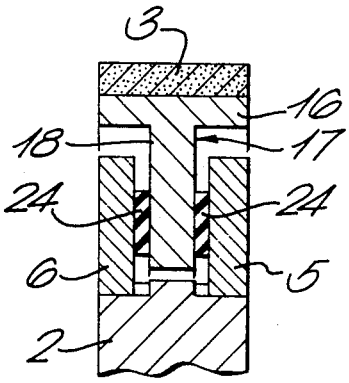
FIG. 3 is a similar section through an alternative grinding wheel.

In the embodiment shown in FIG. 3, the rim 3 is supported for resilient depression radially inwardly of the wheel by rubber, e.g. "Neoprene" rubber, shear pads 24. The grinding wheel is so assembled that the shear pads 24 are kept under compression between the upright 18 and ring members 5,6. Alternatively, the shear pads 24 may be bonded to said upright 18 and ring members 5,6. The shear pads 24 act to return the rim 3 to concentricity after depression thereof radially inwardly of the wheel.

Figure 4:
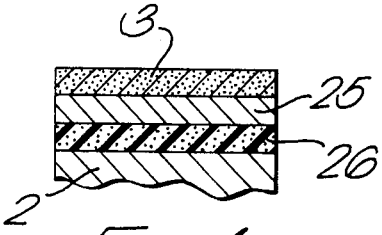
FIG. 4 is a similar section through a further alternative grinding wheel.

In the embodiment shown in FIG. 4, the rim 3 is supported on a thin flexible aluminium hoop 25 which is fitted over a resilient ring 26, e.g. formed of foamed rubber or honeycombed metal, adhered to both the hub 2 and hoop 25. Depression of the rim 3 at any point on its periphery will cause localised deformation thereof so that the rim 3 will lose its circular shape, there being no significant displacement of the rim 3 as a whole. The ring 26 acts to return the rim 3 to its circular shape after depression thereof radially inwardly of the wheel.

In the embodiment shown in FIGS. 5 and 6, the rim 3 is mounted directly on a disc 27, e.g. a metal disc, constituting a hub for the grinding wheel. The disc is apertured or slotted at 28 as shown in a zone 29 spaced from the periphery 30 of said disc 27. The apertures or slots 28 extend axially through the disc 27 and introduce a resilient zone into the disc 27, so that the rim 3, supported on the annulus 31 between the apertures 28 and periphery 30, is resiliently depressible radially inwardly of the wheel.

In the embodiment shown in FIG. 7, the rim 3 is supported on a metallic or non-metallic tire e.g. an aluminium tire 32 bonded at 33 to an aluminium hub 34. The tire 32 is necked at four spaced points 35 as shown, and effectively acts as a flexible beam so that the rim 3 is resiliently depressible radially inwardly of the wheel.

In the embodiment shown in FIG. 8, the rim 3 is bonded to an annulus 36 of "RETIMET" sponge-like porous nickel, as described, for example, in British Pat. No. 1,199,404. The annulus may itself be bonded to the periphery of an aluminium hub 37. Alternatively the whole hub may be of "RETIMET" sponge-like metal. If desired, the rim 3 may be supported on a thin flexible aluminium hoop or ring which is fitted over the annulus 36 and bonded thereto. The sponge-like metal is of coarse structure and has a natural resiliency so that rim 3 is resiliently depressible radially inwardly of the wheel.

Although the grinding wheels described above are of the straight peripheral type (1A1), peripheral grinding wheels of other types may be constructed according to the present invention.

All embodiments of grinding wheel are trued, and if necessary dressed, before being mounted on spindles and put into use in a grinding machine.

The radial static stiffness and the first radial natural frequency of each of the wheels described above was determined. The first radial natural frequency was determined by methods well known in the art, but the radial static stiffness was measured as follows.

Each wheel was mounted on a grinding machine in a condition ready for grinding, i.e. fully tightened. A force- or load-measuring device such as a Kistler Load Washer Type 9011 was then positioned between the periphery of the wheel and a workpiece. A small piece of substantially incompressible material such as tungsten carbide was inserted between the periphery of the wheel and the force-measuring device across the entire width of the wheel rim to ensure that the force was transmitted across the entire width of the wheel rim. The inward linear deflection of the periphery of the grinding wheel rim relative to the machine spindle was measured with a displacement measuring device such as a Tesa (2 micron per division) dial-clock gauge mounted between the spindle and the periphery of the wheel.

The wheel was then infed into the workpiece, or vice versa, one or more times so that the grinding wheel rim was deflected radially inwards by 50 (or preferably 100) microns, to seat the carbide into the wheel. Then infeeding was re-commenced from zero and the force applied in the radial direction to the rim of the grinding wheel per unit radial deflection of the grinding wheel rim was measured. This measurement was repeated four or more times at one position on the wheel, and at four or more positions on the wheel, and the arithmetic mean was determined. The values of force per unit deflection in Newtons/meter per mm of wheel (rim) width were then calculated.

All the wheels had a radial static stiffness of less than $1.5\times10^6$ N/m per mm of wheel width. In each of the grinding wheels described above, at least the outer annulus of each wheel was resiliently depressible.

These wheels were very much more flexible than conventional semi-permanent grinding wheels, including the so-called anti-vibration wheels. For example, the least stiff conventional semi-permanent grinding wheels measured had "Bakelite" hubs and a radial static stiffness of about $(4.2\pm0.5)\times10^6$ N/m per mm of wheel width. Other conventional semi-permanent grinding wheels with phenolic/aluminum hubs had a radial static stiffness of about $(10.3\pm2.0)\times10^6$ N/m per mm of wheel width.

All the wheels of the present invention had a first radial natural frequency in excess of 500 Hertz.

Following the teachings of the present invention, we dramatically modify the structural response of a grinding machine so that it is less liable to cause chatter.

EXAMPLE

This Example describes the production and testing of two peripheral grinding wheels according to the present invention, the hubs of which partly or wholly consist of "RETIMET" sponge-like metal, and the rims of which comprise CBN abrasive particles in a resin bond. Each hub was produced oversize on diameter. Then each hub was placed in a mould and, at conventional pressures and temperatures, resin was impregnated into the rim of the hub. After cooling, the hub was turned to its correct diameter. As a result of this, the rim of the sponge-like hub was sealed with a depth of resin which would subsequently prohibit the resin bond material from penetrating the sponge-like metal which would otherwise cause low bond density. The grinding wheel was then completed in a conventional manner.

Two wheels were manufactured, one of 175 mm diameter, and one of 250 mm diameter. For the larger diameter wheel, the sponge-like metal did not constitute the entire hub material but was in the form of an outer annulus, as shown in FIG. 8, of 25 mm depth. The remainder of the wheel was solid aluminium. The hub of the 175 mm diameter wheel was composed entirely of "RETIMET" sponge-like metal.

Two separate test programmes were run. In the first, the 175 mm wheel was tested on a Jones and Shipman 540 surface grinder and its performance was compared with a similar in-house semi-permanent CBN wheel, manufactured at the same time but with a conventional "Bakelite" hub, and with a standard commercially available semi-permanent CBN wheel also with a "Bakelite" hub. In the second test programme, the 250 mm wheel was tested on a Magerle surface grinder. Its performance was compared with the performance of two other similar 250 mm 1A1 wheels.

Test Programme with 175 mm wheel.
Machine Parameters:
Machine: Jones & Shipman 540
Wheel speed: 35 m/sec.
Table speed: 16 m/min.
Downfeed: 0.025 mm
Crossfeed: 1.7 mm
Workpiece Material: M2 HSS
Coolant: Clearedge EP 284

Wheels: 532B "Bakelite" hub (in-house) and 532R "Retimet" hub (according to the present invention)

Diameter: 175 mm
Width: 9 mm
Matrix Depth: 3 mm
Bond: Resin
Grit type: ABN360
Grit size: 100/120 US mesh
Concentration: 100

Each wheel was tested at the above conditions and the shape of the wheels measured in situ at periods throughout the test programme. The vibration frequencies corresponding to the wheel shape were determined as a further indication of the vibration present during grinding. After grinding for approximately 2 hours, the 532B wheel, examined at a low magnification, was found still to be round with negligible waves. The frequency analysis of the wheel showed no dominant vibration except below 200 Hz which were the frequencies associated with wheel eccentricity and ovality. After grinding for approximately 4 hours, the 532B wheel had started to develop waves around its periphery which were perceptible even at the low magnification. The frequency analysis indicated a dominant vibration at approximately 650 Hz, the natural frequency of the Jones & Shipman 540 machine. Thus, the wheel was already chattering. After approximately 6 hours grinding, the wheel had 11 distinct waves of approximate height 15 $\mu$m. The frequency analysis showed vibration of 650 Hz.

The 532R wheel, after grinding times of 3, 6 and 12 hours, was round with no perceptible waves. The frequency analysis of the wheel indicated that there were no dominant frequencies, except below 200 Hz. There was no sign of chatter after a considerable period of grinding.

The performance of the 532R wheel was compared with the commercially available wheel. This wheel was tested under identical conditions to the 532R wheel. After a grinding time of approximately 6 hours, the wheel had developed twelve significant waves of approximate height 4 $\mu$m.

It is therefore apparent that the 532R wheel was substantially more stable than the two conventional semi-permanent CBN wheels. By "stable" we mean that the amplitudes of vibration and both the wheel and workpiece waves decrease with time rather than increase.

The radial static stiffness of the 532R wheel was $1.4\times10^6$ N/m per mm of wheel width. Its first radial natural frequency was in excess of 1000 Hertz, and its damping was high. The radial static stiffness of the 532R wheel should be compared with the radial static stiffness of the two conventional semi-permanent CBN wheels which was in each case $4.3\times10^6$ N/m per mm of wheel width, i.e. a factor of 3 stiffer.

Test Programme with 250 mm wheel.

Machine Parameters:
Machine Magerle F/10/V/R
Wheel speed: 35 m/sec.
Table speed: 16 m/min.
Downfeed: 0.012 mm
Crossfeed: 7.0 mm
Workpiece Material: M2 and T15 HSS
Coolant: Clearedge EP 284

Wheel Parameters: JSS4 "Retimet" metal annulus (25 mm deep) on solid aluminium hub Diameter: 251 mm
Width: 12 mm
Matrix Depth: 3 mm
Bond: Resin
Grit type: ABN360
Grit size: 100/120 US mesh
Concentration: 100

The JSS4 wheel was tested at the above machining parameters for a total of 12 hours grinding, 9 hours on M2 HSS and 3 hours on T15 HSS. Even after this considerable period of grinding, the wheel was round with no visible waves around its periphery. The frequency analysis indicated an absence of any significant vibration, save that below 200 Hz. Thus, the wheel, even though it had only a 25 mm rim of "Retimet" sponge-like metal, gave stable grinding and performed as well as the above-mentioned 532R wheel.

Two conventional semi-permanent CBN grinding wheels were tested under identical machining conditions. Wheel CH523 had a phenolic/aluminium hub. After only one hour grinding M2 HSS, wheel CH523 had ten distinct waves of approximate height 10 m. Grinding with this wheel was clearly very unstable.

Wheel 100299/B was a commercially available semi-permanent CBN grinding wheel with a so-called "anti-vibration" hub. After 6 hours the wheel had started to develop waves, and after a further 4 hours grinding, these waves were quite substantial, with a height of approximately 10 $\mu$m. Thus, the 100299/B wheel was significantly inferior to the JSS4 wheel as regards stability.

The radial static stiffness of the JSS4 wheel was $0.5\times10^6$ N/m per mm, of wheel width. Its first radial natural frequency was in excess of 1000 Hertz, and its damping was high. The radial static stiffness of the JSS4 wheel should be compared with the radial static stiffness of the two conventional semi-permanent CBN wheels which was $10.5\times10^6$ N/m per mm of wheel width for the CH532 wheel, and $3.7\times10^6$ for the 100299/B wheel.

Since the two grinding wheels 532R and JSS4 gave stable grinding, they did not develop waves around their periphery and thus alleviated the problems that arise from these waves, notably the poor workpiece surface finish. Thus the workpiece surface finish with the two wheels was much superior to that achieved with the conventional wheels, in that it had no perceptible chatter-marks.

The term "margin" as used herein is intended to be understood in its usual sense as denoting an edge-bordering band of indeterminate thickness.

What is claimed is:

1. A semi-permanent grinding wheel suitable for use in a shallow-cut grinding operation, with comparatively low unstable self-excited vibration known as chatter, said semi-permanent grinding wheel comprising:

as a base, a hub constructed and arranged to be rotated about a centrally disposed longitudinal axis;

as a radially outer circumferential rim, an annular structure including a radially outer layer of abrasive particles of ultrahard abrasive grit selected from the group consisting of natural diamond, synthetic diamond and cubic boron nitride bonded in a matrix; and an intermediate annular structure by which said rim is borne on said hub for rotation therewith, said intermediate annular structure including:

two oppositely disposed margins including one constructed and arranged for contiguousness with said rim and another constructed and arranged for contiguousness with said hub, and a core disposed between said margins, said core being constructed and arranged to be resiliently deformable;

at least one of said intermediate annular structure and said annular structure which provides said rim further including an annular support functionally interposed in supporting relation between said radially outer layer of abrasive particles and said resiliently deformable core of said intermediate annular structure;

said grinding wheel having so low an oscillating mass, that its first radial natural frequency, measured by exciting the wheel on its radially outer periphery while its hub is held stationary, is at least 500 hertz; and said grinding wheel having so high a degree of resilient deformability in said core of said radially intermediate annular structure, that its radial static stiffness, determined by measuring the force applied inwards in the radial direction to the rim of the grinding wheel across the entire width of the rim (at an angularly small site on the rim) per unit radial deflection of the grinding wheel rim at that site, is less than $1.5\times10^6$ newtons per meter per mm of wheel rim width.

2. The semi-permanent grinding wheel of claim 1, wherein:

said annular support is constructed and arranged to be sufficiently flexible that when a force is applied radially inwards on the radially outer periphery of the rim at an angularly small site in the course of performing a shallow-cut grinding operation on a workpiece, the rim may resiliently locally deflect generally radially inwardly relative to the hub in the vicinity of said angularly small site with the remainder of said rim remaining substantially concentric with said hub.

3. The semi-permanent grinding wheel of claim 2, wherein:

said annular support is constituted by a thin flexible metallic hoop and said intermediate annular structure constituted by a resilient ring adhered to said hoop and connected to said hub.

4. The semi-permanent grinding wheel of claim 3, wherein:

said resilient ring is made of foamed rubber.

5. The semi-permanent grinding wheel of claim 2, wherein:

said resilient ring is made of honeycombed metal.

6. The semi-permanent grinding wheel of claim 3, wherein:

said hoop is made of aluminum.

7. The semi-permanent grinding wheel of claim 3, wherein:

said resilient ring is constituted by an annulus of sponge-like porous metal.

8. The semi-permanent grinding wheel of claim 7, wherein:

said hub is made of aluminum to which said annulus of sponge-like porous metal is bonded.

9. The semi-permanent grinding wheel of claim 7, wherein:

said hub is made of the same sponge-like porous metal as said resilient ring.

10. The semi-permanent grinding wheel of claim 9, wherein:

said sponge-like porous metal is constituted by nickel.

* * * * *